US012330025B1

(12) United States Patent
Hammond

(10) Patent No.: US 12,330,025 B1
(45) Date of Patent: Jun. 17, 2025

(54) DISC GOLF DISC RETRIEVAL DEVICE AND METHOD OF USE

(71) Applicant: Shawn Hammond, McKinney, TX (US)

(72) Inventor: Shawn Hammond, McKinney, TX (US)

( * ) Notice: Subject to any disclaimer, the term of this patent is extended or adjusted under 35 U.S.C. 154(b) by 777 days.

(21) Appl. No.: 17/575,473

(22) Filed: Jan. 13, 2022

(51) Int. Cl.
*A63B 47/02* (2006.01)
*A63B 67/06* (2006.01)

(52) U.S. Cl.
CPC ..... *A63B 47/02* (2013.01); *A63B 67/06* (2013.01)

(58) Field of Classification Search
CPC ..... A63B 47/02; A63B 67/06
See application file for complete search history.

(56) References Cited

U.S. PATENT DOCUMENTS 4,021,068 A * 5/1977 Piazza ..... A63B 47/02 294/19.2
5,199,716 A * 4/1993 DeFluiter ..... A63B 43/005 273/412
7,066,511 B2 * 6/2006 Newman ..... H01K 3/32 81/53.11
7,934,756 B2 * 5/2011 Kroeze ..... B25J 1/04 294/115
8,657,351 B2 * 2/2014 Johnson ..... A63F 9/0001 403/291
9,265,997 B1 * 2/2016 Good, Jr. ..... A63B 57/00
9,945,513 B2 * 4/2018 Whitney ..... A47K 1/09
2006/0055189 A1 * 3/2006 Dalsing ..... A63B 57/00 294/19.2
2011/0221219 A1 * 9/2011 Heaton ..... A63B 47/02 294/210
2018/0345087 A1 * 12/2018 Batista ..... A63B 47/02

FOREIGN PATENT DOCUMENTS

DE 9215917 U1 * 6/1993

OTHER PUBLICATIONS

Amazon.com, Bird Dog Disc Golf Retriever Pole , Jul. 27, 2021, https://www.amazon.com/Bird-Disc-Golf-Retriever-Pole/dp/B09BBXLSMT?ref_=ast_sto_dp (Year: 2021).*

* cited by examiner

*Primary Examiner* — Stephen A Vu

(57) ABSTRACT

A disc golf disc retrieval device and method of use of the same are disclosed. The disc golf disc retrieval device includes a retrieval head removably connected to a telescoping pole via a connection mechanism. The retrieval head includes a spherical member having a plurality of suction cups extending therefrom. The plurality of suction cups is configured to enable engagement of a disc golf disc thereto.

3 Claims, 3 Drawing Sheets

DISC GOLF DISC RETRIEVAL DEVICE AND METHOD OF USE

BACKGROUND

1. Field of the Invention

The present invention relates generally to disc golf, and more specifically to a device that assists players to retrieve a disc golf disc from difficult environment settings.

2. Description of Related Art

Disc golf has been growing in popularity within the past few years. Disc golf is a flying disc sport which involves players throwing discs into a series of disc golf baskets on a course. The goal of disc golf is to throw the disc toward each disc golf basket in the lowest number of throws. The player who has the lowest number of throws at the end of each course is the winner.

While playing disc golf is enjoyable, the retrieval of disc golf discs can be painstakingly frustrating. For example, after a disc golf disc is thrown, the disc golf disc can land in various unreachable areas such as in bodies of water, rough vegetation, trees, or other terrain that requires significant retrieval effort from the player.

Accordingly, it is an object of the present invention to provide a device that enables a player to retrieve a disc golf disc more readily, thereby providing for improved user convenience.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
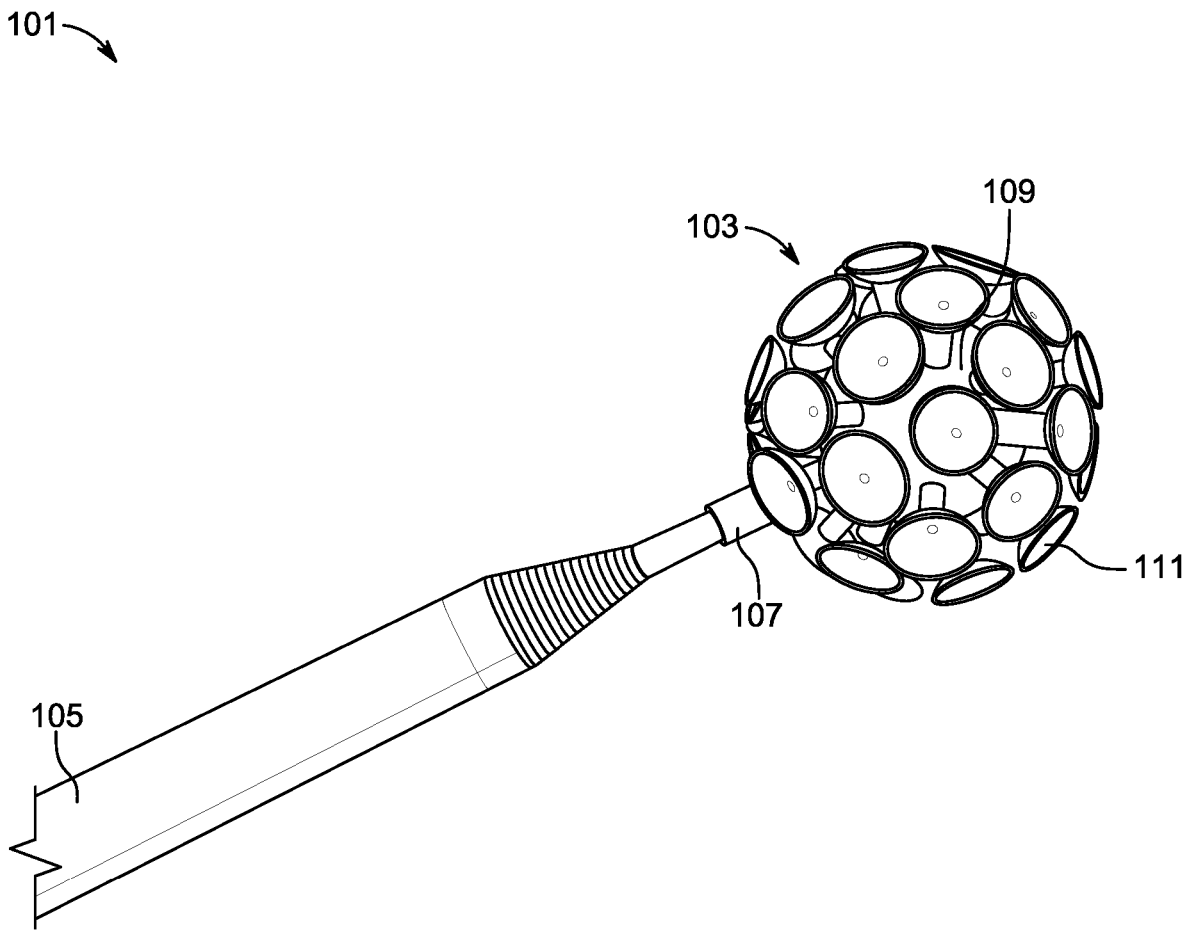
FIG. 1 is a perspective view of a disc golf disc retrieval device in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with playing disc golf. Specifically, the present invention allows a player to retrieve a disc golf disc more readily from unreachable areas. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a perspective view of a disc golf disc retrieval device 101 in accordance with a preferred embodiment of the present application. It will be appreciated that disc golf disc retrieval device 101 overcomes one or more of the above-listed problems commonly associated with playing disc golf. In addition, it should be appreciated that the disc golf disc retrieval device 101 may vary based on aesthetical, functional, or manufacturing considerations.

In the contemplated embodiment, the disc golf disc retrieval device 101 comprises a retrieval head 103 removably connected to a telescoping pole 105 via a connection mechanism 107. The retrieval head 103 includes a spherical member 109 having a plurality of suction cups 111 extending therefrom. The plurality of suction cups 111 is configured to enable engagement of a disc golf disc thereto. In the preferred embodiment, the plurality of suction cups 111 include brightly colored materials, colored patterns, images, or the like to provide improved visibility of the retrieval head in poor visibility conditions.

It should be appreciated that the telescoping pole 105 may be made from any suitable or desired materials including conventional materials known and used in the art, such as graphite-based materials, composite or other non-metals, steel materials, aluminum materials, other metal alloy materials, polymeric materials, combinations of various materials, and the like.

It should also be appreciated that the connection mechanism 107 may be any fastening means for removably connecting the retrieval head 103 to the telescoping pole 105 including, without limitation, screws, bolts, magnets, rivets, pins, friction-based means, other fastening means, or any combination or multiplicity thereof.

In some embodiments, the plurality of suction cups 111 may be integrally formed as part of the spherical member 109 or may be separately formed and engaged therewith (e.g., by adhesives or cements; by welding, brazing, soldering, or other fusing techniques; by mechanical connectors; by magnets; etc.).

It should be appreciated that the plurality of suction cups 111 may be made from any suitable or desired materials including, without limitation, rubber materials (e.g., natural or synthetic), polymer materials, leather materials, metal materials, combinations of various materials, or any combination or multiplicity thereof.

It should also be appreciated that one of the unique features believed characteristic of the present application is that it utilizes a plurality of suction cups to engage with a disc golf disc for easy retrieval from unreachable areas.

Figure 2:
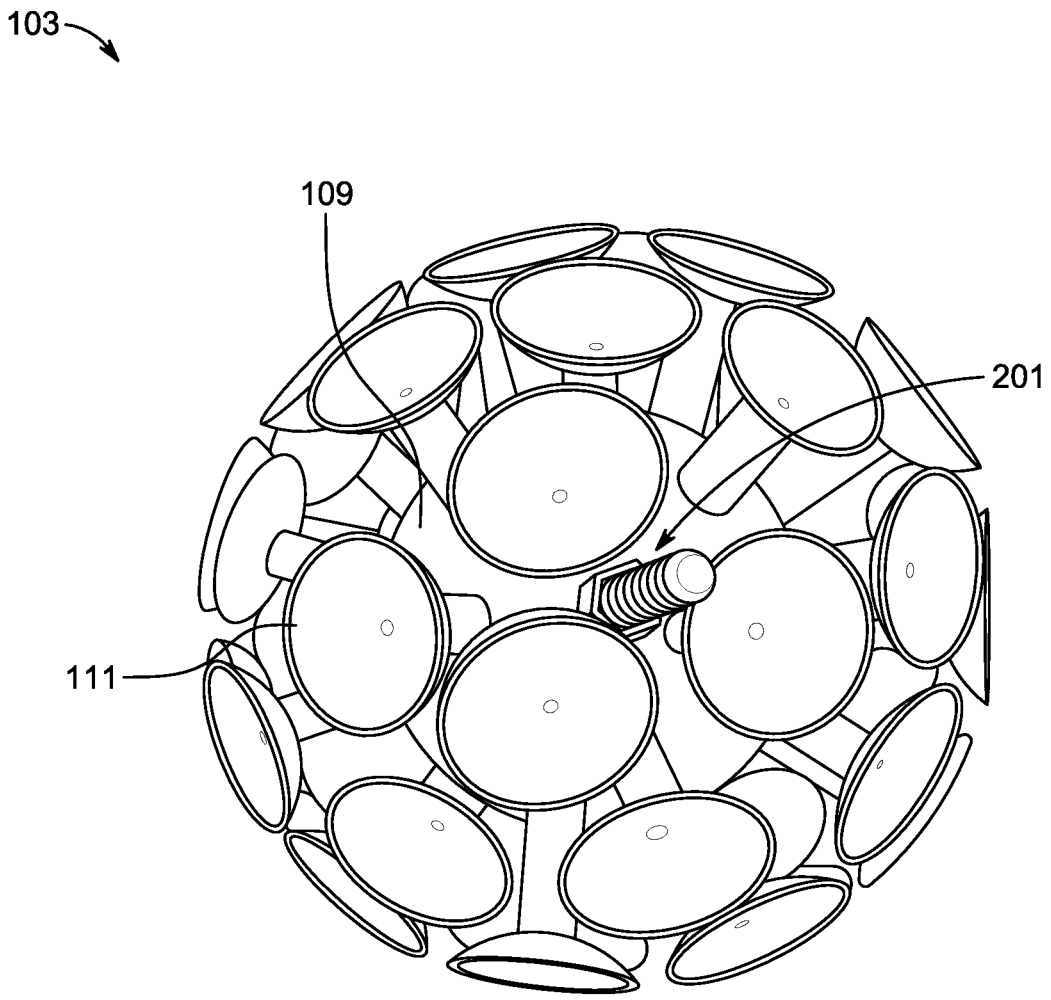
FIG. 2 is a perspective view of the retrieval head of FIG. 1.

In FIG. 2, a perspective view of the retrieval head 103 is depicted. As shown, the retrieval head 103 may include one or more connection elements 201 that complement the connection mechanism 107. It should be appreciated that the one or more connection elements 201 may be any fastening means that complements the connection mechanism 107 including, without limitation, screws, bolts, magnets, rivets, pins, friction-based means, other fastening means, or any combination or multiplicity thereof. In some embodiments, the connection mechanism 107 may be eliminated and the one or more connection elements 201 may removably couple directly to the telescoping pole 105.

Figure 3:
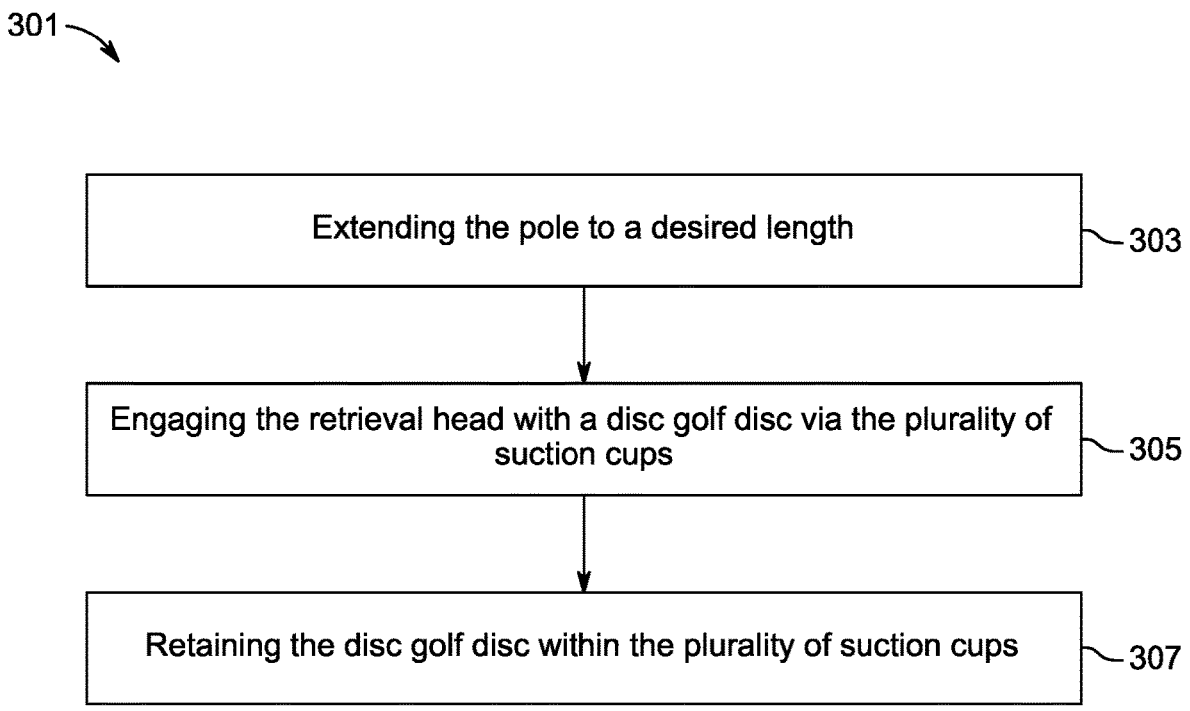
FIG. 3 is a flowchart of a method of use of the disc golf disc retrieval device of FIG. 1.

In FIG. 3, a flowchart 301 depicts a simplified method of use associated with the disc golf disc retrieval device 101. During use, the pole can be extended to a desired length, as shown with box 303. Then, the retrieval head is engaged with a disc golf disc via the plurality of suction cups, as shown with box 305. The disc golf disc is retained within the plurality of suction cups, as shown with box 307.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A disc golf disc retrieval device, comprising:

a spherical member;

a plurality of suction cups extending from the spherical member, the plurality of suction cups configured to enable engagement of a disc golf disc thereto; and a telescoping pole, wherein the spherical member is secured to the telescoping pole via a threaded securement member.

2. A method of retrieving a disc golf disc, the method comprising:

providing a disc golf disc retrieval device, the disc golf disc retrieval device comprising:

a retrieval head, the retrieval head having:

a spherical member; and a plurality of suction cups extending from the spherical member, the plurality of suction cups adapted to enable engagement of a disc golf disc thereto;

a telescoping rod; and a connection mechanism adapted to removably connect the retrieval head with the telescoping rod;

extending the telescoping rod to a desired length;

engaging the retrieval head with a disc golf disc via the plurality of suction cups; and securing the disc golf disc to the plurality of suction cups.

3. The method of claim 2, wherein the retrieval head further comprises one or more connection elements configured to complement the connection mechanism.

* * * * *